US005755449A

United States Patent [19]

Pozzobon

[11] Patent Number: 5,755,449

[45] Date of Patent: May 26, 1998

[54] IN-LINE SKATE

[75] Inventor: Alessandro Pozzobon, Paderno di Ponzano Veneto, Italy

[73] Assignee: Nordica, S.P.A., Trevignano, Italy

[21] Appl. No.: 331,826

[22] Filed: Oct. 31, 1994

[30] Foreign Application Priority Data

Nov. 9, 1993 [IT] Italy ..... TV93A0097

[51] Int. Cl.[6] ..... A63C 17/14

[52] U.S. Cl. ..... 280/11.2; 188/5; 280/11.22

[58] Field of Search ..... 188/5, 29; 280/11.2, 280/11.22, 11.21

[56] References Cited

U.S. PATENT DOCUMENTS

| | | | |
|---|---|---|---|
| 979,169 | 12/1910 | Kennedy | 280/11.36 X |
| 1,402,010 | 1/1922 | Ormiston | 280/11.2 |
| 1,687,739 | 10/1928 | Slusher | 280/11.2 |
| 2,179,592 | 11/1939 | Goetiie | 280/11.2 |
| 3,767,220 | 10/1973 | Peterson | 280/11.2 |
| 4,275,895 | 6/1981 | Edwards | 280/11.2 |
| 5,088,748 | 2/1992 | Koselka et al. | 280/11.2 |
| 5,232,231 | 8/1993 | Carlsmith | 280/11.2 |
| 5,487,552 | 1/1996 | Daoust | 280/11.2 |

FOREIGN PATENT DOCUMENTS

| | | | |
|---|---|---|---|
| 0 594 080 A2 | 10/1993 | European Pat. Off. . | |
| 11117 | 5/1909 | United Kingdom | 280/11.2 |

*Primary Examiner*—Brian L. Johnson
*Assistant Examiner*—Michael Mar
*Attorney, Agent, or Firm*—Hale and Dorr LLP

[57] ABSTRACT

Skate of the type including a shell with which at least one quarter is articulated and below which a frame is associated; the frame carries a plurality of aligned wheels. A support for a first brake is oscillatably articulated to the frame; the brake is connected to the quarter by means of a rod member. A second brake is also connected to the support and interacts with at least one of the wheels beyond a selected degree of rotation applied to the quarter.

24 Claims, 6 Drawing Sheets

IN-LINE SKATE

BACKGROUND OF THE INVENTION

The present invention relates to an in-line skate.

Skates are known constituted by a shell and at least one quarter articulated thereto. A usually C-shaped frame is also associated below the shell.

Two or more aligned wheels are pivoted between the wings of said frame.

For this conventional skate there is currently the problem of achieving optimum wheel braking in order to be able to stop and also to adjust the speed.

For this purpose it is known to associate a block or pad, usually made of rubber, with the wheel supporting frame in a region that is adjacent either to the heel or to the toe. When the user tilts the shoe and thus the frame forward or backward, the free end of the block or pad interacts with the ground and braking is thus achieved.

However, these solutions are not optimum, since they require the user to impart a given rotation, at the toe or heel regions, to the shoe and thus to the frame associated therewith, and this can cause a loss of balance with consequent falls.

U.S. Pat. No. 1,402,010 discloses a roller skate provided with a band that can be secured at the user's leg above the malleolar region; a rod is connected to said band.

Said rod surrounds the leg to the rear and is then curved so as to laterally affect the leg until it is associated, at its ends, in the malleolar region, with a lever system which is articulated to a structure that protrudes from the wheel supporting frame.

The lever system protrudes to the rear of the frame and is connected to a plate which is shaped approximately complementarily to the curvature of part of an underlying and facing wheel.

This solution is not free from drawbacks: first of all, a relative movement between the band and the leg is produced throughout sports practice, and this does not make its use comfortable due to the continuous rubbing of the band on the leg.

Furthermore, the plate is activated every time the user bends his leg backward beyond a given angle, with no true and easy possibilities to vary this condition.

Still, each user has a different leg shape, and braking is thus achieved at different rotation angles for an equal rod length.

Furthermore, the rod acts and presses in the malleolar region, and this can cause discomfort or accidental impacts.

U.S. Pat. No. 333,751 discloses a skate having, below the support for the shoe, a supporting frame for two mutually parallel wheels to which the elbows of two essentially L-shaped arms are articulated towards the rear region of the shoe.

An auxiliary wheel and two brakes which face the rolling surface of the wheels are articulated respectively to the free ends of each arm.

There is also a spring which, during normal use of the skate, keeps the brakes away from the surface of the wheel and keeps the auxiliary wheel raised from the ground.

In this solution, too, a backward rotation of the shoe is followed by the interaction of the auxiliary wheel with the ground and thus by the interaction of the brakes with the rolling surface of the wheels.

Even this solution has some of the above mentioned drawbacks, with the additional drawback that it requires optimum tuning and continuous checking of the condition of the spring to avoid unwanted jamming.

U.S. Pat. No. 4,275,895 discloses a brake for skates having two pairs of mutually parallel wheels, which acts at the rear wheels.

This brake is constituted by a tongue which is associated with the shoe at the rear. A blade is associated with the tongue in a rearward position and is pivoted at the supporting frame of the shoe.

At its free end, the blade has a transverse element on which a pair of C-shaped elements is formed at the lateral ends. Following a backward rotation imparted to the tongue, the C-shaped elements interact with the rear wheels that face them, so as to interact with the rolling surface of the wheels.

Even this solution, however, has drawbacks: it is in fact structurally complicated and thus difficult to industrialize. Furthermore, it entails the presence of adapted springs that allow the tongue to return to the position in which the pair of C-shaped elements does not interact with the wheels, and this further increases structural complexity.

Furthermore, the structural configuration of the brake causes the pair of C-shaped elements to interact with the wheel even upon a minimal backward rotation imparted to the tongue and thus even for involuntary movements: this entails unwanted braking actions and thus possible loss of balance or lack of coordination.

Eventually, the interaction of the C-shaped element at the rolling surface of the wheels leads to rapid wear of the wheels and thus to a non-optimum rolling which necessarily entails continuous replacement of the wheels.

U.S. Pat. No. 4,300,781 discloses a braking device for skates that comprise pairs of mutually parallel wheels. The braking device comprises a blade that is transversely pivoted at the rear end of the supporting frame of the shoe. Pads face the rolling surface of the pair of rear wheels and are associated with the ends of the blade.

The brake is activated by using a cable which is adapted to rotate the blade, in contrast with a spring associated with the support for the pair of front wheels, so as to move the pads into contact with the rolling surface of the pair of rear wheels.

The cable can be activated by means of rings or handles associated with a band which can be arranged on the user's legs by virtue of temporary connection means.

However, this solution has considerable drawbacks: first of all, brake activation can lead to possible loss of balance during sports practice, since the user does not assume, with his body, a position suitable to control the sudden speed reduction; only the skater's hand is in fact involved in brake activation.

Furthermore, since sports practice can occur while wearing trousers, when the rings are pulled the band may slip along the trousers or pull them so that they slide along the leg, hindering the braking action.

Moreover, there is a loose cable which, in addition to being a hindrance to the skater, can accidentally catch during skating, especially since coordination of the arm-legs movement places the legs rhythmically laterally outward.

European patent 0 379 906 discloses a roller skate with a braking device which comprises a lever that is rotatably associated with the wheel support and has a pawl that protrudes to the rear of the skate and oscillates in contrast with a spring.

When the pawl is lowered towards the ground, part of the lever interacts with the underlying rolling surface of the wheel and with the rolling surface of an adjacent wheel.

In an alternative embodiment one end of the lever, which is again pivoted at the wheel support, faces the surface of the underlying wheel and the other end is connected to a pad that interacts with the ground.

In the latter case, the braking action is achieved by means of the interaction of the pad with the ground.

Even these solutions, however, have drawbacks: in the first solution it is not possible for the user to achieve a gradual adjustment of the braking action, since he cannot act rapidly, simply and safely on the pawl.

Even in the second described solution, the braking action is not continuous, since the user is unable to adjust the interaction of the pad with the ground in an optimum manner, since this action occurs in an unsteady balance condition.

SUMMARY OF THE INVENTION

The aim of the present invention is therefore to solve the described technical problems, eliminating the drawbacks described above in the prior art and thus providing a skate in which it is possible to achieve an optimum braking action safely and easily.

Within the scope of this aim, an important object is to provide a skate in which the braking action can be gradual according to the specific requirements of the user.

Another important object is to provide a skate in which the braking action can be activated and possibly increased rapidly, simply and safely by the user.

Another object is to provide a skate which associates with the preceding characteristics that of being reliable and safe in use, of having low manufacturing costs, and of being applicable even to conventional skates.

This aim, these objects and others which will become apparent hereinafter are achieved by an in-line skate comprising at least one quarter articulated to a shell, a frame supporting a plurality of aligned wheels, and a support for a first brake oscillatably articulated to said frame, said first brake being connected to said quarter by means of a rod member, characterized in that it comprises a second brake interacting with at least one of said wheels beyond a selected degree of rotation of said at least one quarter.

BRIEF DESCRIPTION OF THE DRAWINGS

Further characteristics and advantages of the invention will become apparent from the following detailed description of some particular but not exclusive embodiments, illustrated only by way of non-limitative example in the accompanying drawings, wherein.

DESCRIPTION OF THE PREFERRED EMBODIMENTS

Figure 1:
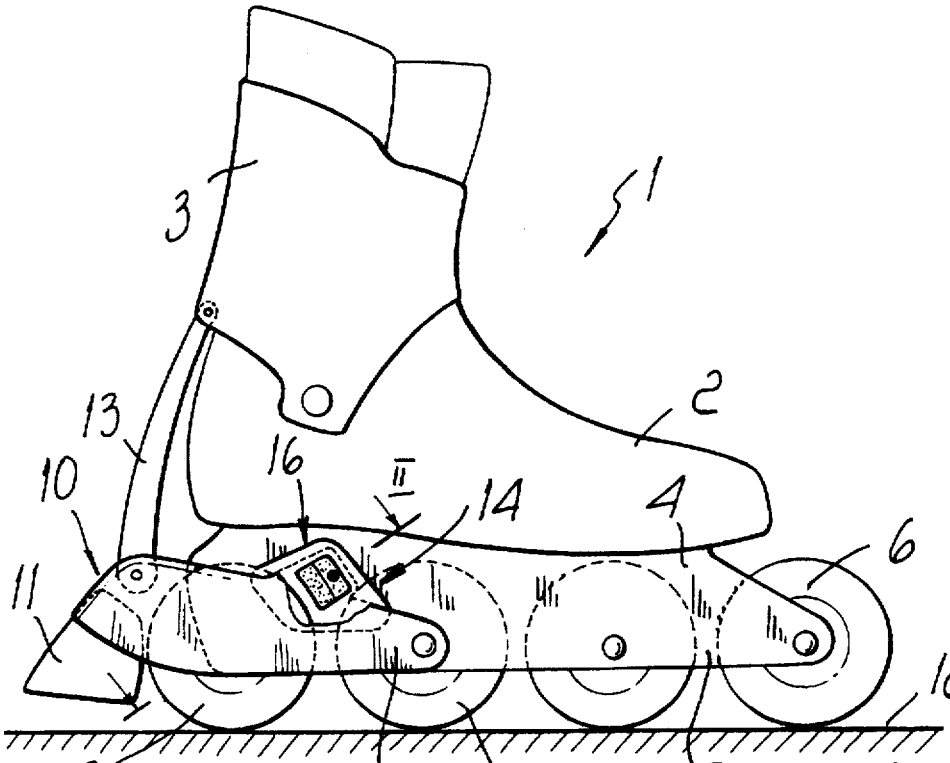
FIG. 1 is a side view of the skate in the condition in which the first and second brakes are not activated.
Figure 2:
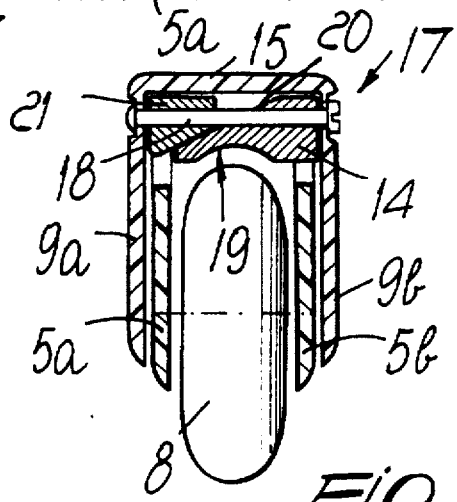
FIG. 2 is a sectional view, taken along the plane II–II of FIG. 1.
Figure 3:
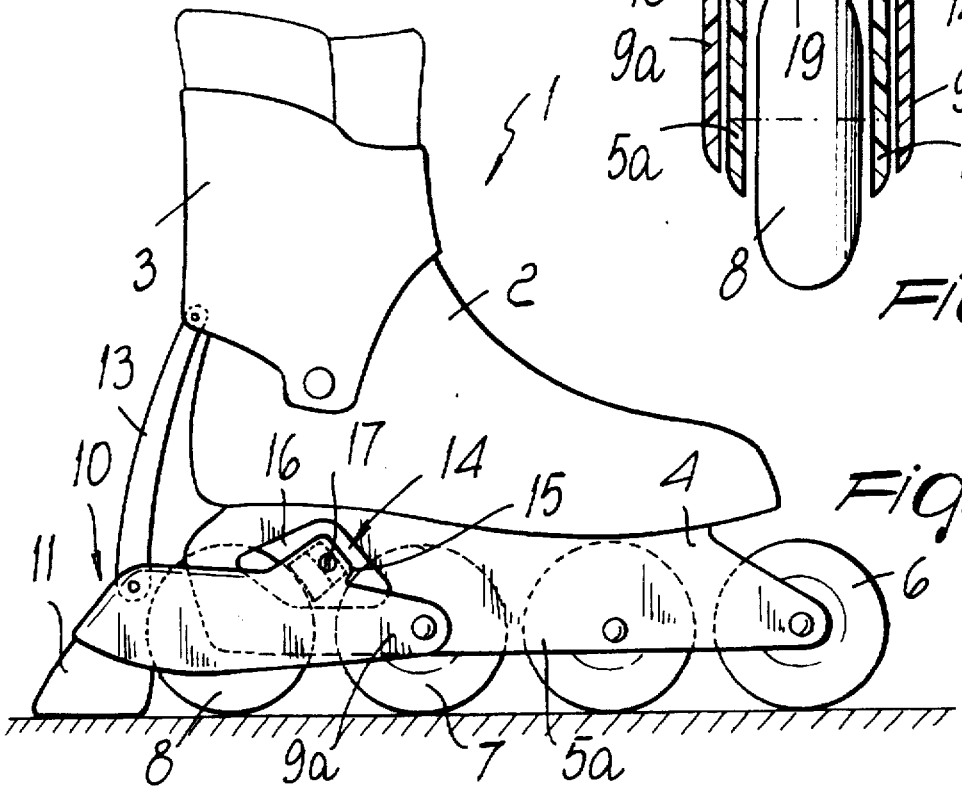
FIG. 3 is a view of the skate of FIG. 1 in the condition in which both the first and the second brakes are activated.

With reference to the above figures, the reference numeral 1 designates the skate, which is constituted by at least one quarter 3 oscillatably associated with a shell 2.

An essentially C-shaped frame 4 is associated below the shell 2. Two or more aligned wheels 6 are pivoted between the wings **5*a* and 5*b*** of said frame so as to be freely rotatable.

The ends of the tabs **9*a* and 9*b* of a support 10, which protrudes to the rear of the rear wheel 8, are pivoted at the frame 4**.

A first brake 11 is associated with said support 10 and is constituted by a first pad, made of plastics or rubber, which is suitable to interact with the ground 12. The end of a rod member 13 is instead oscillatably associated with the support 10 on the side opposite to said first brake. At its other end, the rod member is pivoted to the rear of the quarter 3.

A backward rotation of the quarter 3 thus causes the oscillation of the support 10 and consequently the interaction of the first brake 11 with the ground 12.

The skate also includes a second brake 14 constituted by a second pad which is slidingly associated at an adapted cross-member 15. Cross-member 15 connects the tabs **9*a* and 9*b* of the support 10 and passes at an adapted opening 16 formed on the wings 5*a* and 5*b* of the frame 4 in a region that lies at least above the rear wheel 8**.

The brake can also be located in the interspace between other adjacent wheels.

The second brake 14 is thus connected to the cross-member by using an adapted screw 17 which has a head 18 that is accessible to the user at one end and is rotatably and freely associated with the tab **9*a*** at its other end.

The cross-member 15 has a selected inclination with respect to the ground and interacts with means that allow to adjust its position with respect to the rear wheel 8.

The second brake 14 in fact has a first surface 19 which is shaped complementarily with respect to the facing rolling surface of the rear wheel 8. The second brake has, in transverse cross-section, essentially the shape of a right triangle, and a complementarily shaped inclined plane of a block 21, associated with the stem of the screw 17 by means of a seat which is threaded complementarily to said stem, interacts with the hypotenuse 20 of said triangle.

The rotation of the screw 17 therefore entails a movement of the block 21 along the axis of the stem of said screw; this movement forces the second brake 14 to move towards the rolling surface of the wheel 8 so as to decrease their gap to the desired value.

The operation of the brake according to the invention is in fact as follows: a backward inclination of the quarter 3 is followed, by virtue of the rod member 13, by an oscillation of the support 10 and thus by a first interaction of the first brake 11 with the ground 12.

In this step, the second brake 14 can be adjusted so that its first surface 19 interacts or not with the facing rolling surface of the rear wheel 8. This interaction can in fact be achieved after the first brake has made contact with the ground and thus as a consequence of a further tilt given to the quarter and therefore, for example, if the user wishes to achieve a sharper braking action.

The adjustment of the position of the second brake 14 with respect to the rear wheel 8 can allow the user to preset the intervention of the second brake, in addition to the first one, to the desired degree of rotation of the quarter 3.

Of course the position of the first brake 11 with respect to the ground can also be adjusted by conventional means.

It has thus been observed that the invention has achieved the intended aim and objects, a skate having been provided which allows to safely and easily achieve an optimum braking action that can be made gradual, according to the specific requirements, directly by the user by applying the desired backward inclination to the quarter.

This adjustment of the degree of the braking action is achieved quickly, simply and safely by the user.

The skate according to the invention is susceptible to numerous modifications and variations, all of which are within the scope of the same inventive concept.

Figure 4:
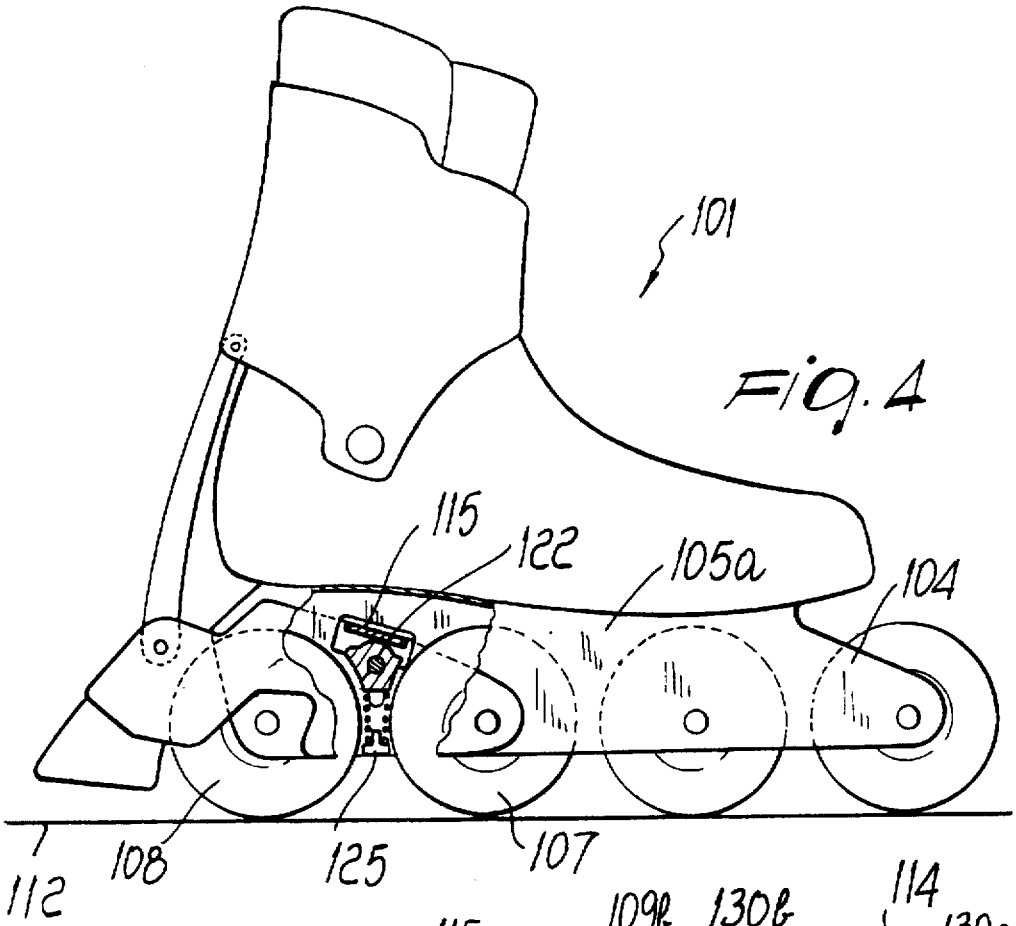
FIG. 4 is a view, similar to FIG. 1, of a further embodiment in the condition in which the first and second brakes are not activated.
Figure 5:
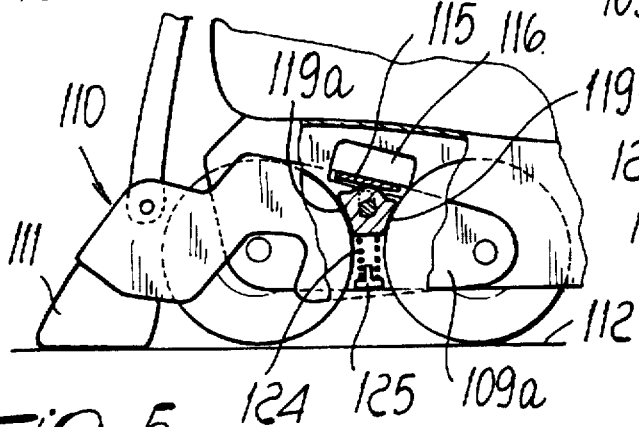
FIG. 5 is a detail view of the skate according to FIG. 4, in the condition in which both the first and the second brakes are activated.
Figure 6:
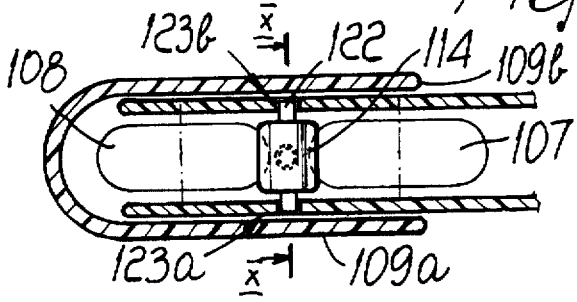
FIG. 6 is a schematic top view of the second brake.

Thus, for example, FIGS. 4, 5, and 6 illustrate a further embodiment for a skate 101 wherein the second brake 114 is again constituted by a second pad which can move approximately at right angles to the ground 112 in the interspace between at least one intermediate wheel 107 and the rear wheel 108.

Advantageously, the second brake 114 has first surfaces 119*a* and 119*b* which are shaped approximately complementarily to the respective rolling surfaces of the rear wheel 108 and of the intermediate wheel 107 and face them.

The second brake 114 is transversely pivoted to a pivot 122 which is slidingly associated, at its ends, at two slots 123*a* and 123*b* which are formed approximately at right angles to the ground 112 at the wings 105*a* and 105*b* of the frame 104.

The movement of the second brake 114 at the pair of slots occurs in contrast with a flexible means constituted by a spring 124 that interacts with the lower surface of the second brake 114 and with an adapted abutment 125 which is arranged transversely at the ends of the wings 105*a* and 105*b* of the frame 104.

The movement of the second brake 114 towards the rolling surfaces of the wheels occurs by virtue of an adapted cross-member 115 which connects the upper ends of the tabs 109*a* and 109*b* of the support 110 for the first brake 111. The cross-member 115 can move at an adapted opening 116 formed on the wings 105*a* and 105*b* of the frame 104.

Figure 10:
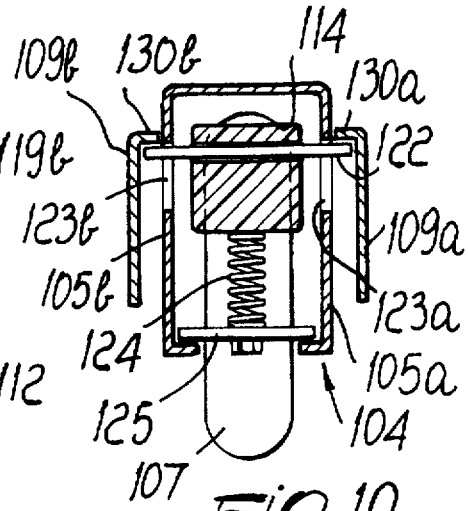
FIG. 10 is a sectional view, taken along the plane X—X of FIG. 6.

As an alternative, motion can be transmitted to the second brake 114 by appropriately provided abutments 130*a* and 130*b* which protrude from the tabs 109*a*, 109*b* towards the frame and interact, during the backward rotation of the quarter, with the ends of the pivot 122 that protrude from the pair of slots 123*a*, 123*b*, as shown in FIG. 10.

This solution, too, like the preceding one, allows the user to achieve a gradual braking action simply by rotating the quarter backward. The adjustment can be achieved for example by varying the shape of the second brake 114 or the elastic constant of the spring 124, as well as by appropriately adjusting the first brake 111 with means.

Figure 7:
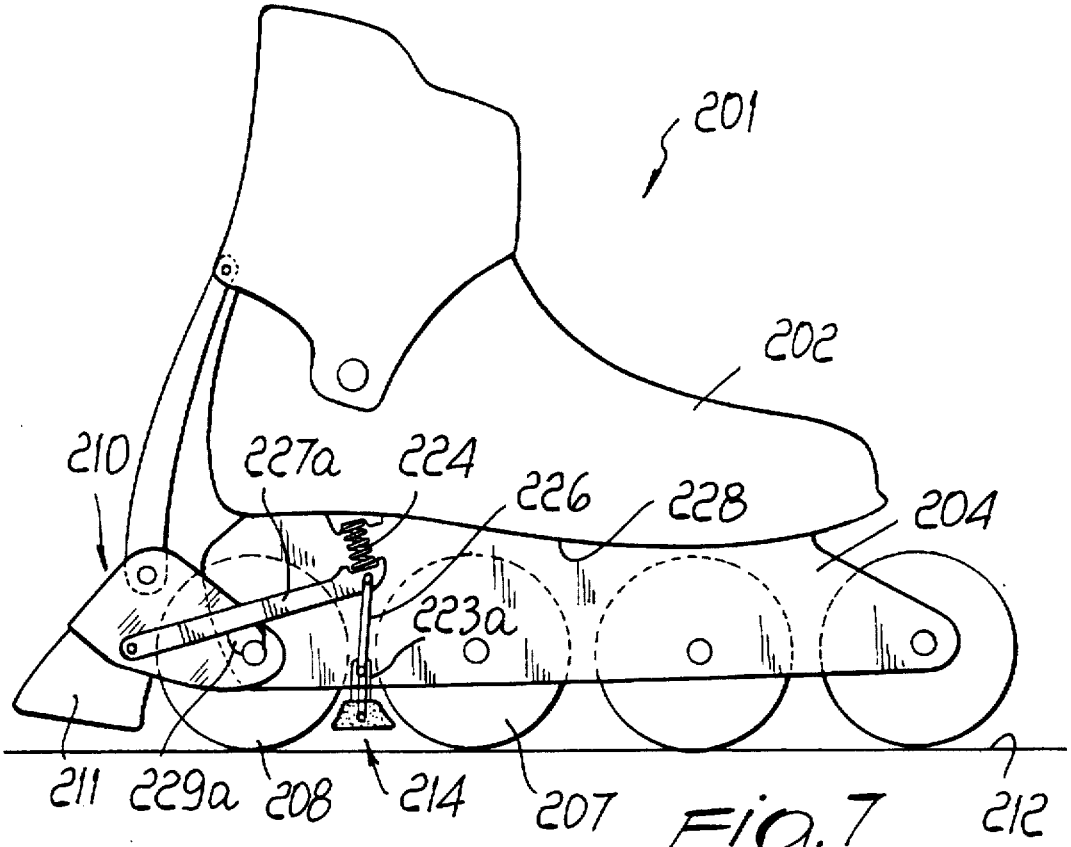
FIG. 7 is a view, similar to FIG. 1, of a further embodiment.
Figure 8:
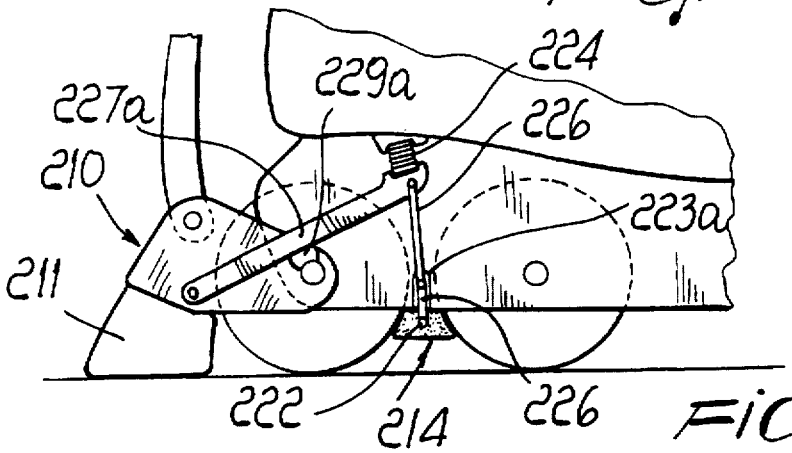
FIG. 8 is a view of the embodiment shown in FIG. 7 in the condition in which both the first and the second brakes are activated.
Figure 9:
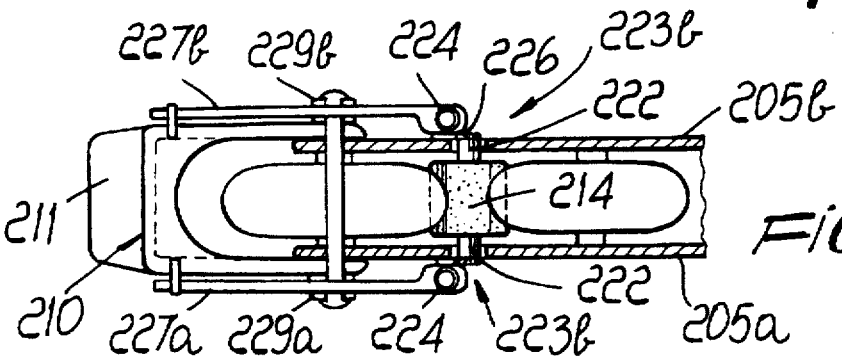
FIG. 9 is a top view of the solution shown in FIGS. 7 and 8.

FIGS. 7, 8, and 9 illustrate a skate 201, according to a further aspect of the invention, comprising a second brake 214 which is arranged transversely with respect to the wings 205*a* and 205*b* of the frame 204 in a region that lies between at least one intermediate wheel 207 and the rear wheel 208 and in a position that is adjacent to the ground 212.

The second brake 214 is thus associated with a pivot 222 which can slide approximately at right angles to the ground 212 by virtue of the presence of two appropriately provided slots 223*a* and 223*b* formed starting from the free end of the wings 205*a* and 205*b*.

A rigid bar and/or a traction element, such as a cable, designated by the reference numeral 226, is associated with each one of the ends of the pivot 222 and is rotatably associated, at its other end, at the end of two links 227*a* and 227*b*.

The links are arranged outside the support 210 for the first brake 211 and are rotatably associated with said support 210 at their ends that do not interact with the cable or rigid bar 226.

The links are forced towards the ground by an adapted flexible element, such as a spring 224, which is interposed between the sole 228 of the shell 202 and the end of the two links 227*a* and 227*b* with which the cable or rigid bar 226 is associated.

Two blocks 229*a* and 229*b*, located above the pivot that pivots the support 210 to the frame 204, cooperate to form a stroke limit for the oscillation of said two links towards the ground.

This solution, too, allows to provide a gradual braking action by rotating the quarter backward.

The intervention of the second brake 224 can be altered by appropriately sizing the length of the cable or rigid bar 226, or by appropriately setting the springs 224.

The stroke limit for the movement of the second brake towards the wheels can be constituted by the depth of the two slots 223*a* and 223*b* formed on the wings 205*a* and 205*b* of the frame 204.

Figure 11:
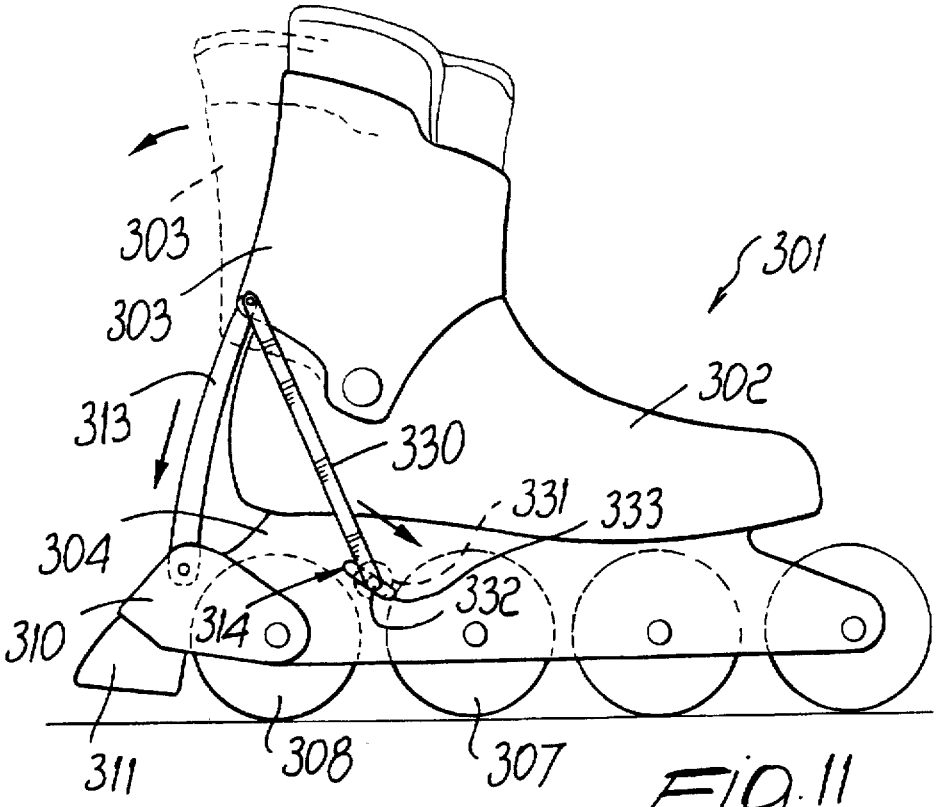
FIG. 11 is a side schematic view of a skate according to a further aspect of the invention.

FIG. 11 shows a skate 301 constituted by a frame 304 carrying in-line wheels 307, 308 and by a shoe having a shell 302 and a quarter 303 pivoted thereto.

A support 310 is pivoted to frame 304 and carries a brake pad 311. A first rod member 313 is pivoted to the quarter 303 and to the support 310.

A second rod member 330 is pivoted to quarter 303 and to a second brake member 314, constituted by a roll or pad acting on either wheel 307 or 308 or both.

Advantageously, second rod member 330 is constituted by two rods arranged on either side of the shell 302. The second brake member 314 advantageously comprises a pad or roll 331 pivoted to the second rod member 330 at a pivot 332 which runs in a slot 333 provided in the frame 304.

Figure 12:
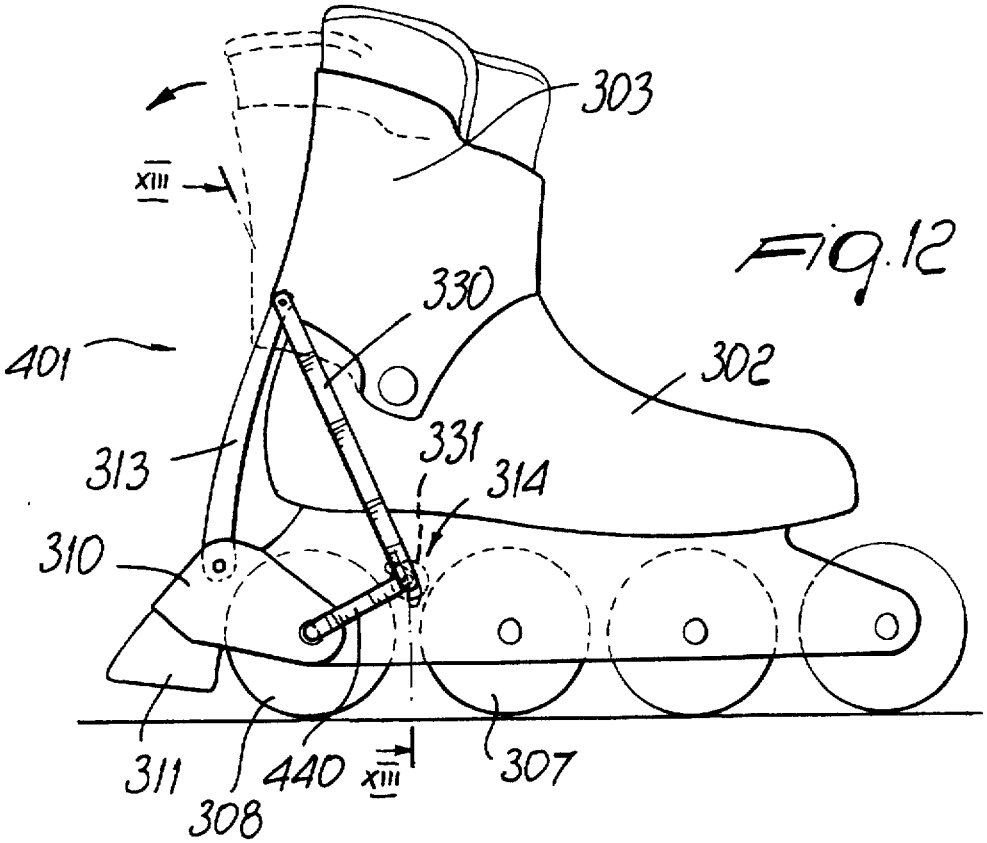
FIG. 12 is a side schematic view of a skate according to still a further aspect of the invention.
Figure 13:
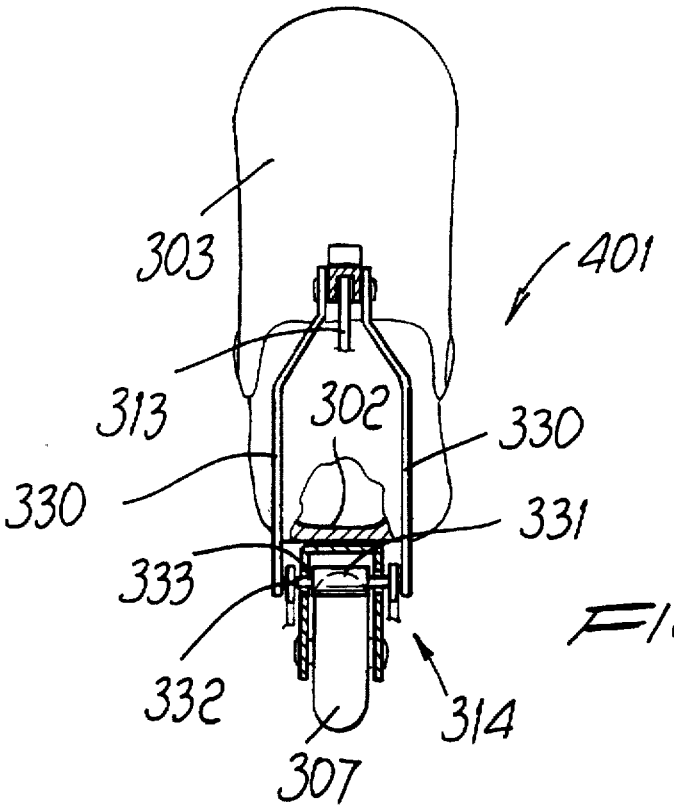
FIG. 13 is a rear section view of the skate according to the line XIII—XIII of FIG. 12.

When the quarter 303 is tilted back, the first brake 311 and then the second brake 331 are activated, or vice versa, depending on the dimensions of the rod members. FIGS. 12 and 13 show a skate 401 substantially similar to skate 301, described above, having however a further third rod member 440 connecting pivot 332, of the second brake member 314, to the support 310.

Reference numerals of FIGS. 12 and 13 identical to those of FIG. 11, designate similar components. The brake system shown in FIGS. 12 and 13 provides a greater control of the braking action on the two brakes.

Figure 14:
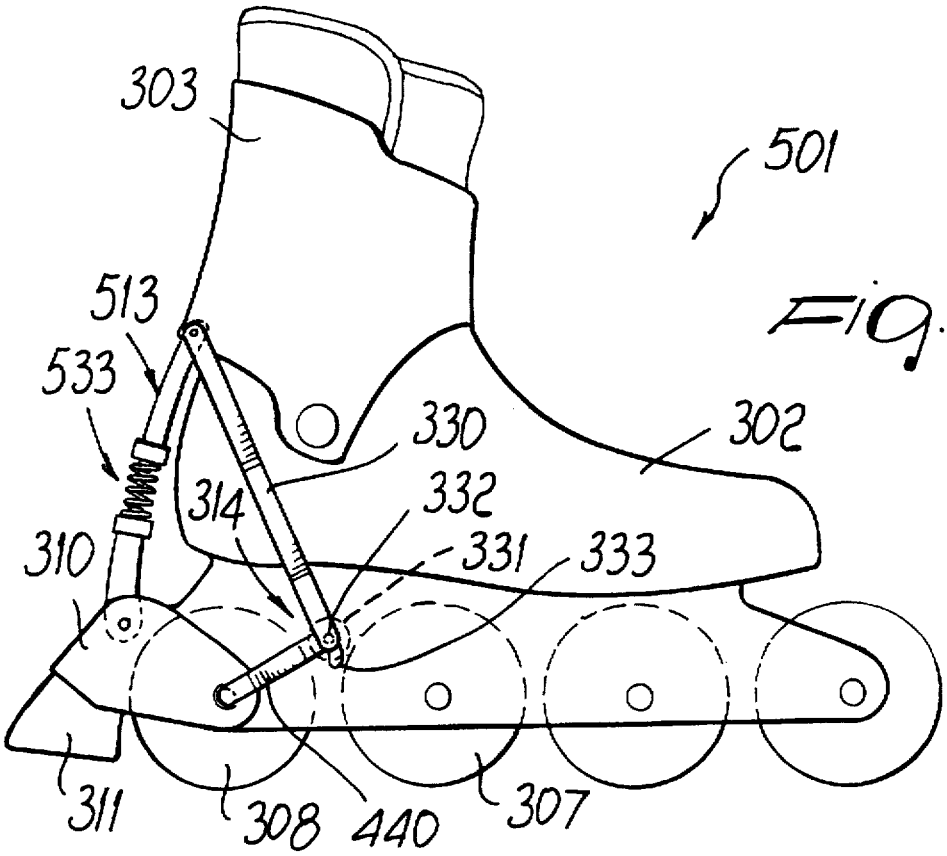
FIG. 14 is a side schematic view of a skate according to a further aspect of the invention.

FIG. 14 shows a skate 501 which is a modification of the skates shown in FIGS. 11–13. Again, identical reference numerals designate similar components in FIGS. 11–14.

Skate 501 has a first rod member 513 constituted by two pieces separated by an elastic member 533. In this manner, the braking action is effected first on the second brake 314 and then on the first brake 311.

Figure 15:
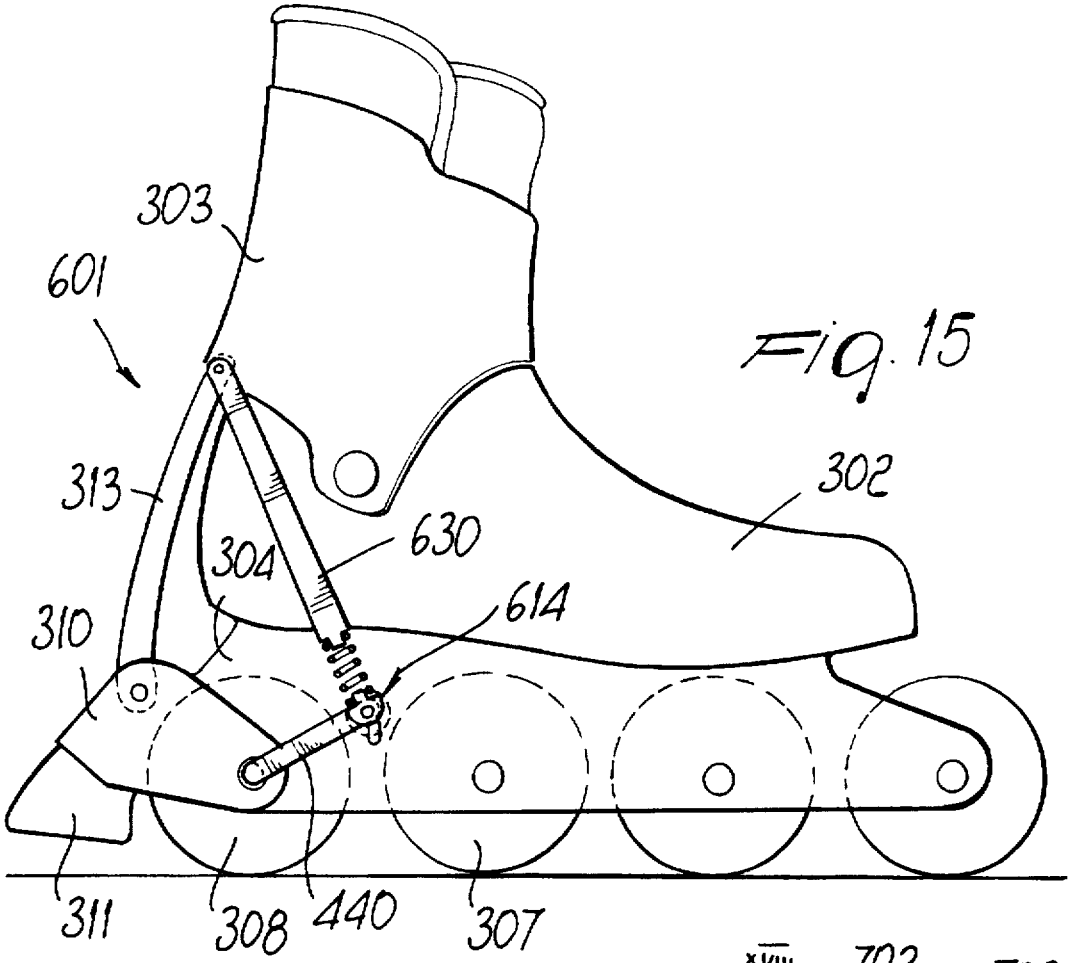
FIG. 15 is a side schematic view of a skate according to still a further aspect of the invention.
Figure 16:
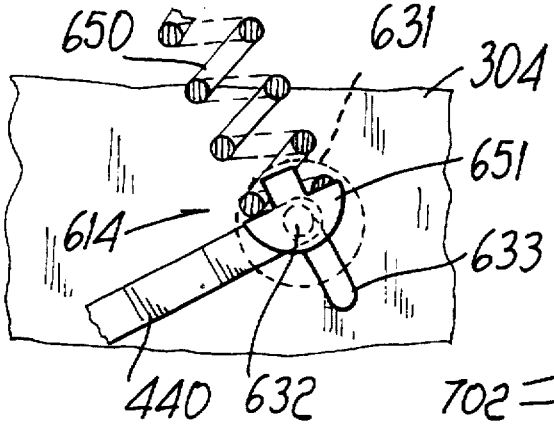
FIG. 16 is a detail view of a joint of the skate of FIG. 15.

FIGS. 15 and 16 show a skate 601 which is a further modification of the skates shown in FIGS. 11–13. Again, identical reference numerals designate similar components in FIGS. 11–16. Skate 601 has a second-rod member 630 pivoted to the second brake member 614 through an elastic member 650.

More in detail, as shown in FIG. 16, second rod member 630 is connected to an end member 651 with the interposition of a spring 650. End member 651 has a pivot 632 running in a slot 633 provided at the frame 304.

In this manner, the braking action is effected first on the first brake 311 and then on the second brake 614.

Figure 17:
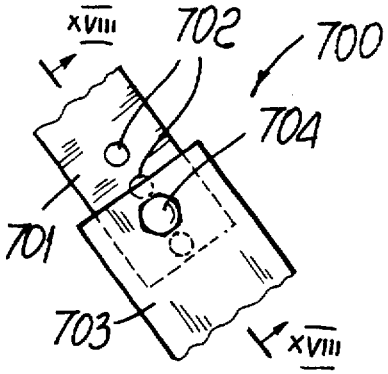
FIG. 17 is a side detail view of an adjusting member.
Figure 18:
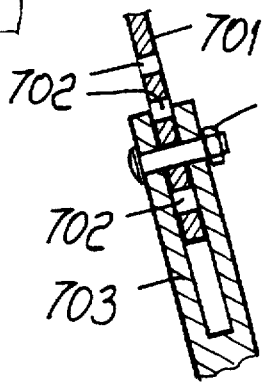
FIG. 18 is a section view according to the line XVIII—XVIII of FIG. 17.

FIGS. 17 and 18 show an adjusting system 700 which can be applied to any of the rod members shown above. Adjuster 700 is constituted by a first rod piece 701 having a plurality of holes 702 and inserted in a second rod piece 703. Second rod piece 703 has a bolt 704 adapted to engage one of the holes 702.

The material and the dimensions that constitute the individual components of the skate may naturally be the most pertinent according to the specific requirements.

What is claimed is:

1. An in-line skate comprising a quarter articulated to a boot having a shell, a frame attached to the shell and supporting a plurality of aligned wheels, a first brake having a ground engageable brake pad, a support for said first brake connected to said frame, a rod member extending generally between said quarter and said first brake and arranged to move said brake pad into ground engagement in response to a predetermined degree of rotation of said quarter, and a second brake operatively attached to said quarter and arranged to interact with at least one of said wheels in response to rotation of said quarter beyond said predetermined degree of rotation.

2. Skate according to claim 1, wherein said support for said first brake has two tabs pivoted at said frame, said second brake being constituted by a second pad which is associated at an adapted cross-member which connects said tabs of said support and passes at an adapted opening formed on said frame in a region that lies above at least one of said wheels.

3. Skate according to claim 2, wherein said cross-member is located in the interspace between the rear wheel and an intermediate wheel which is adjacent thereto.

4. Skate according to claim 2, wherein said second brake is connected to said cross-member by means of an adapted screw which has a head that can be accessed by the user at one end and is freely rotatably associated with one of said tabs at the other end.

5. Skate according to claim 4, wherein said cross-member has a selected inclination with respect to the ground and interacts with means that allow adjustment of their position at least with respect to said rear wheel.

6. Skate according to claim 1, wherein said second brake is constituted by a second pad which can move approximately at right angles to the ground in the interspace that lies between at least two intermediate wheels, such as the rear wheel and the wheel that is adjacent thereto.

7. Skate according to claim 6, wherein said second brake has first surfaces which are shaped approximately complementarily to the respective rolling surfaces of said mutually adjacent wheels and face them.

8. Skate according to claim 7, wherein said second brake is pivoted transversely to a pivot which is slidingly associated, at its ends, at two slots formed approximately at right angles to the ground at said frame.

9. Skate according to claim 8, wherein the movement of said second brake at said pair of slots occurs in contrast with a flexible element constituted by a spring which interacts with the lower surface of said second brake and with an abutment located transversely at the ends of the wings of said frame.

10. Skate according to claim 9, wherein the movement of said second brake towards the rolling surfaces of said mutually adjacent wheels occurs by virtue of an adapted cross-member which connects the upper ends of said tabs of said support for said first brake, said cross-member being movable at an adapted opening formed on said wings of said frame.

11. Skate according to claim 8, wherein the movement is transmitted to said second brake by adapted abutments which protrude from said tabs of said support towards said frame and interact, during the backward rotation of said quarter, with the ends of said pivot that protrude from said pair of slots.

12. Skate according to claim 1, wherein said second brake is arranged transversely to wings of said frame in a region that lies between at least two mutually adjacent wheels and in a position which is adjacent to the ground.

13. Skate according to claim 12, wherein said second brake is associated with a pivot that can slide approximately at right angles to the ground by virtue of the presence of two suitable slots formed starting from the free end of said wings.

14. Skate according to claim 13, wherein a rigid bar and/or a traction element, such as a cable, is associated with each one of the ends of said pivot and is rotatably associated, at its other end, at the end of two links which are located on the outside of said support for said first brake and are rotatably associated with said support at the ends which do not interact with said cable or rigid bar.

15. Skate according to claim 14, wherein said links are forced towards the ground by means of at least one flexible element, such as a spring, which is interposed between the sole of said shell and the end of said pair of links with which said cable or said rigid bar is associated.

16. Skate according to claim 15, wherein it comprises a stroke limit for the oscillation of said pair of links towards the ground, said stroke limit being constituted by two blocks which are arranged above the pivot for pivoting said support to said frame.

17. Skate according to claim 1, wherein said second brake is connected to said quarter by a second rod member.

18. Skate according to claim 17, wherein said second brake is connected to said support by a third rod member.

19. Skate according to claim 18, wherein said second brake comprises a roll supported by a pivot associated with at least said second rod member, said pivot being adapted to slide in a slot provided at said frame.

20. Skate according to claim 19, wherein said second rod member is connected to said second brake by means of an elastic member.

21. Skate according to claim 20, wherein said first rod member is constituted by a first rod piece and a second rod piece connected by an elastic member.

22. An in-line skate comprising at least one quarter articulated to a boot having a shell, a frame attached to the shell and supporting a plurality of aligned wheels, a support for a first brake oscillatably articulated to said frame, said support having two tabs pivoted at said frame and said first brake being connected to said quarter by a rod member, and a second brake constituted by a second pad which is associated with an adapted cross-member which connects said tabs of said support and passes at an adapted opening formed on said frame in a region that lies above at least one of said wheels, said second brake interacting with at least one of said wheels beyond a selected degree of rotation of said at least one quarter, said second brake being connected to said cross-member by means of an adapted screw which has a head that can be accessed by the user at one end and is freely rotatably associated with one of said tabs at the other end, said cross member having a selected inclination with respect to the ground and interacting with means that allow adjustment of the position of said cross-member at least with respect to said rear wheel, said second brake having a first surface which is shaped complementarily to the facing rolling surface of said rear wheel, said second brake having, in transverse cross-section, essentially the shape of a right triangle, a complementarily shaped inclined plane of a block associated with the stem of said screw by means of a seat which is threaded complementarily to said stem, interacting with the hypotenuse of said triangle.

23. Skate according to claim 22,wherein the rotation of said screw entails a movement of said block along the axis of the stem of said screw, said movement forcing said second brake to move towards the rolling surface of the facing wheel so as to reduce its interspace to the intended value.

24. An in-line skate comprising:

a quarter articulated to a boot having a shell, a frame attached to the shell and supporting a plurality of aligned wheels, a support for a first brake connected to said frame, said first brake having a ground engageable pad movable into ground engagement in response to a predetermined degree of rotation of said quarter, and a second brake operatively attached to said quarter, said second brake being responsive to rotation of said quarter and being arranged to interact with at least one of said wheels in response to rotation of said quarter beyond said predetermined degree of rotation, said second brake defining a first surface which is shaped complementarily to a facing surface of said one wheel and is arranged to interact with said one wheel.

* * * * *